US005568157A

United States Patent [19]

Anderson

[11] Patent Number: 5,568,157

[45] Date of Patent: Oct. 22, 1996

[54] DUAL PURPOSE, LOW PROFILE ANTENNA

[75] Inventor: Philip M. Anderson, Shepton Mallett, United Kingdom

[73] Assignee: Securicor Datatrak Limited, United Kingdom

[21] Appl. No.: 497,140

[22] Filed: Jun. 30, 1995

Related U.S. Application Data

[63] Continuation of Ser. No. 184,469, Jan. 21, 1994, abandoned.

[30] Foreign Application Priority Data

Jan. 25, 1993 [GB] United Kingdom ..... 9301400

[51] Int. Cl.[6] ..... H01Q 1/32

[52] U.S. Cl. ..... 343/713; 343/729; 343/752

[58] Field of Search ..... 343/713, 725, 343/729, 749, 752, 767, 825, 828, 829, 830, 846, 847, 848, 700 MS

[56] References Cited

U.S. PATENT DOCUMENTS

| | | | |
|---|---|---|---|
| 2,611,865 | 9/1952 | Alford | 343/769 |
| 3,967,276 | 6/1976 | Goubau | 343/752 X |
| 4,313,121 | 1/1982 | Campbell et al. | 343/828 X |
| 4,493,802 | 4/1984 | Mayes | 343/729 |
| 4,661,821 | 4/1987 | Smith | 343/846 X |
| 4,821,040 | 4/1989 | Johnson et al. | 343/713 X |
| 5,055,852 | 10/1991 | Dusseux et al. | 343/725 |
| 5,170,493 | 12/1992 | Roth . | |
| 5,181,044 | 1/1993 | Matsumoto et al. . | |

FOREIGN PATENT DOCUMENTS

| | | | |
|---|---|---|---|
| 0174068 | 12/1986 | European Pat. Off. | H01Q 9/04 |
| 0278070 | 8/1988 | European Pat. Off. | H01Q 1/32 |
| 0394931 | 10/1990 | European Pat. Off. | H01Q 13/18 |
| 0403910 | 12/1990 | European Pat. Off. | H01Q 5/01 |
| 0093305 | 7/1980 | Japan | 343/700 MS |
| 58-29203 | 2/1983 | Japan | 343/700 MS |
| 2005922 | 4/1979 | United Kingdom | 343/700 MS |
| 1595277 | 8/1981 | United Kingdom | H01Q 5/00 |

OTHER PUBLICATIONS

Copy of European Search Report dated May 10, 1994 (4 pages).

Patent Abstracts of Japan, vol. 8, No. 99 (E–243) (1563) May 10, 1984.

"Analysis of a probe–fed microstrip disk antenna"; Chew, et al; pp. 185–191; Apr. 1991.

"40th IEEE Vehicular Technology Conference", May 1990, Orland, Florida (pp. 19–23).

Garg et al., A Microstrip Array of Concentric Annular Rings, Jun. 1985, pp. 655–659.

*Primary Examiner*—Michael C. Wimer
*Assistant Examiner*—Tho Phan
*Attorney, Agent, or Firm*—Harness, Dickey & Pierce, P.L.C.

[57] ABSTRACT

A low profile, dual purpose antenna for simultaneous UHF and LF use has two coplanar antenna elements, one of which is circular and the other of which is a concentric annulus separated from it by a dielectric, as well as a third, linear antenna element extending from the center of the circular element. The circular element serves both to assist in tuning the UHF section of the antenna and as a voltage probe for the electrostatic component of the LF signal. Integrated within the antenna housing is a high input impedance, low noise amplifier for bandwidth limiting the LF signals. A coaxial feeder cable serves to connect both UHF and LF sections of the antenna to external equipment. Entry for the coaxial feeder cable into the antenna housing is through a threaded collar, which also acts as a single point fixing of the antenna to the roof of a vehicle.

24 Claims, 2 Drawing Sheets

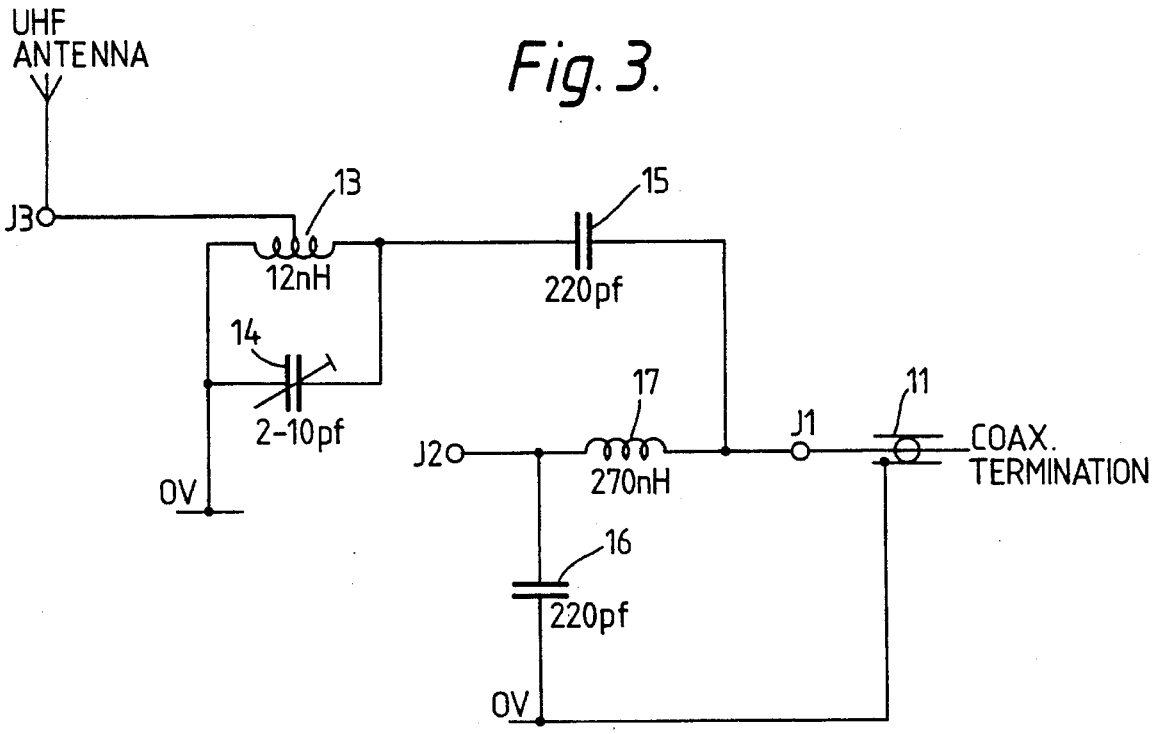
Fig. 3.
Fig. 4.
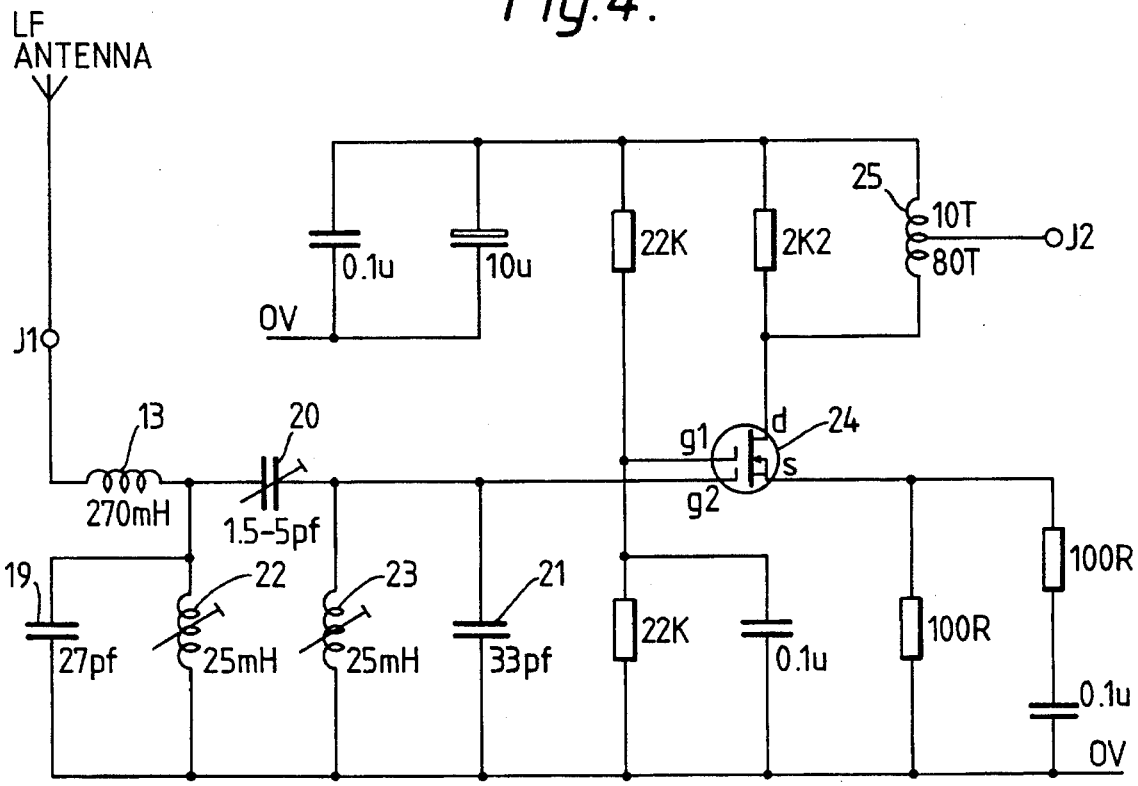

DUAL PURPOSE, LOW PROFILE ANTENNA

This is a continuation of U.S. patent application Ser. No. 08/184,469, filed Jan. 21, 1994, now abandoned.

BACKGROUND AND SUMMARY OF THE INVENTION

The present invention relates to a dual purpose antenna, that is an antenna which is capable of operating with signals in widely separated parts of the radio spectrum simultaneously, and in particular to a dual purpose antenna which has a low physical profile.

Generally speaking, an antenna is designed to operate in a relatively restricted region of the radio spectrum and is optimised for operation in that region.

Recent work in the field of mobile communications has led to a requirement for radio operation in widely separated regions of the radio spectrum. In mobile cellular radio systems, mobile transceivers communicate with one another via a network of fixed base stations using signals in the UHF part of the spectrum. On the other hand, mobile location systems such as Datatrak (RTM) use signals from static locator beacons transmitted at very low frequencies to enable equipment (known as a mobile location unit or MLU) on a vehicle or other moving object to determine its location for any of a number of purposes, and the location determined by the MLU is reported to a base station via a UHF transmission from the mobile for purposes such as monitoring the position of the mobile.

In addition to monitoring the position of a mobile for reporting back to a base station it has also been proposed to make use of a mobile location unit for other purposes. For example, in the case of a mobile equipped with a cellular radio transceiver, optimum values of various operating parameters of the transceiver depend on its position and a MLU may be used to adapt or condition the operation of the transceiver according to its calculated position. For example the calculated location may also be used to adapt or condition the operation of a mobile's cellular radio transceiver to local characteristics of the cellular radio network, for example what transmitter power and which frequency channels to use. (see our British Patent No 87/11490 "Mobile Transmitter/Receiver").

The wavelengths of radio waves at the frequencies used in applications such as cellular radio and the data transmissions used in systems such as Datatrak on the one hand and low frequency mobile location systems on the other differ by several orders of magnitude making it difficult to design a single antenna which is usable with both.

The present invention provides a dual purpose antenna usable with radio signals in two widely separated regions of the radio spectrum simultaneously and which comprise high frequency and low frequency sections usable with signals in the higher and lower of the two regions respectively, the high and low frequency sections being integrated into an antenna assembly which comprises an antenna arrangement tuned and loaded for operation in the high frequency region and a voltage probe for receiving the E-component of signals in the low frequency region.

The antenna arrangement may include a number of antenna elements, one of which serves also as the voltage probe.

In particular, it may comprise first and second planar conductive antenna elements separated by a dielectric, the first element being a radiating/receiving element for the high frequency signals and the second element serving both as part of a resonant circuit including the first element in its high frequency operation and as the LF voltage probe.

The HF section may have a third, linear radiating element whose axis extends out of the plane of the first and second elements from the centre of the first element, whereby the antenna acts to radiate signals in the high frequency region omnidirectionally, the radiated signals being polarised in the direction of the axis of the third element.

Using a voltage probe to pick up the E-component (electric component) of the low frequency signal frees the antenna from having its dimensions constrained by the wavelength of the low frequency signals.

As will become apparent from the following description, the present invention permits a dual purpose antenna to be produced which is physically compact and of a low profile which is convenient in itself and enables the antenna to be packaged in an enclosure which is resistant to tampering, (e.g. by someone attempting to disable communication from the mobile), while permitting a single-point fixing to the roof of a vehicle or other moving object.

In one particularly convenient form, the antenna elements are disposed as two electively conductive areas of metal foil on a dielectric substrate, with the first element being in the form of a circular disk which is concentric with and spaced from the second element which takes the form of a circular annulus.

BRIEF DESCRIPTION OF THE DRAWINGS

The invention will be further described by way of non-limitative example with reference to the accompanying drawings, in which:

FIG. 3 shows the circuitry associated with the HF section and diplexer of the antenna of FIG. 1; and FIG. 4 shows the circuitry associated with the LF section of the antenna of FIG. 1.

DETAILED DESCRIPTION OF THE PREFERRED EMBODIMENTS

Figure 1:
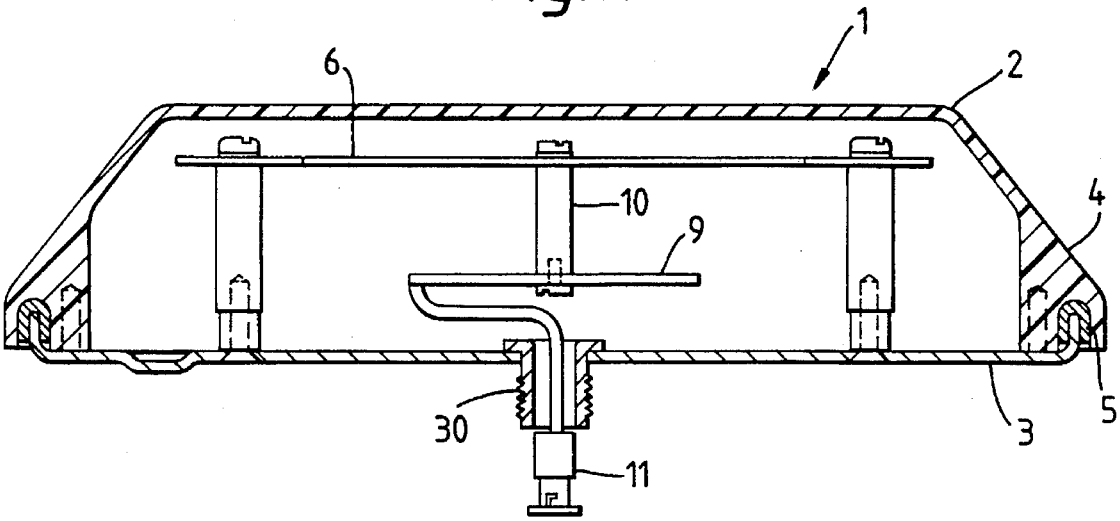
FIG. 1 is a horizontal diametral cross section of an antenna embodying the present invention.

FIG. 1 shows a horizontal section through one embodiment of the invention for use in transmitting and receiving high frequency signals in the UHF region (e.g 460 MHz) as used in the Datatrak system for data transmission, while simultaneously receiving location signals transmitted by the Datatrak system which operates on a frequency of 140 KHz. The wavelengths involved are therefore of the order of 65 cms for the UHF signals and 2.1 km meters for the low frequency ones. The UHF section transmits omnidirectional, vertically polarised UHF signals.

The antenna assembly, generally designated 1, is wholly contained within a weather- and tamper-proof housing 2 comprising a circular metal baseplate 3 and a cover 4 of tough plastics material. A seal 5 in the form of an inverted U located in a groove in the underside of the cover 4 surrounds and seals against the upturned peripheral rim of the baseplate 3 to render the housing watertight. The baseplate 3 serves as a ground plane for the antenna circuitry.

Within the housing a circular disk shaped element 6 manufactured as a printed circuit board is mounted above and parallel to the baseplate 3 by a number of angularly spaced stand-offs or mounting pillars around its periphery, and one at its centre.

Figure 2:
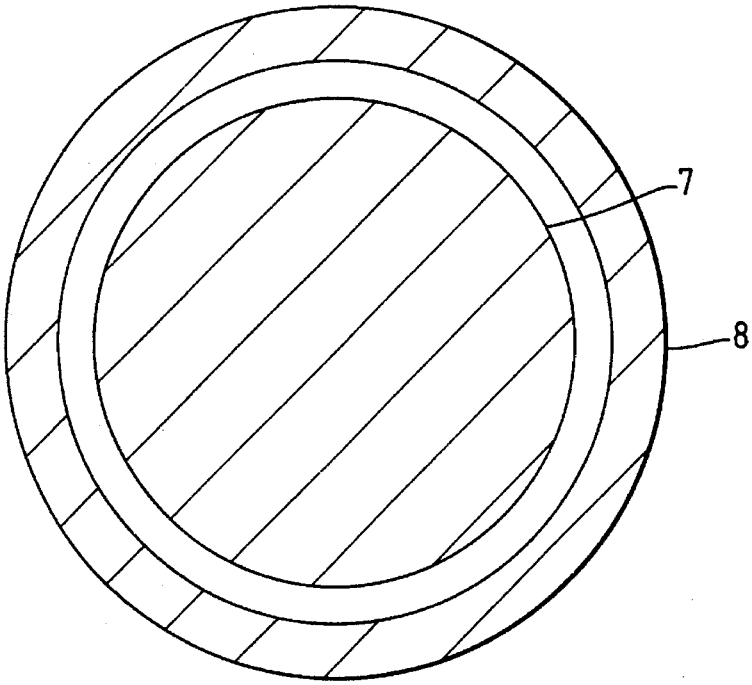
FIG. 2 illustrates schematically the layout of the first and second radiator elements of the antenna of FIG. 1.

The disk 6 comprises a circular substrate of dielectric material having antenna elements 7 and 8 on it in the form of two concentric metal (copper) foil layers laid out as shown in FIG. 2.

A rectangular printed circuit board 9 is mounted to the base plate 3 by means of stand offs so as to be located below the centre of the antenna element 7. A linear vertical UHF radiating element 10 in the form of a rod shaped metal support pillar extends upwardly from the centre of the PCB 9 and is electrically connected to the radiating element 7 by a screw through the centre of disk 6. The circuit board 9 also has on it circuitry, described below, to couple the elements 7 and 8 to a coaxial cable fed through a single point fixing collar 30 of the antenna to the roof of the mobile so the antenna can be installed by drilling a single hole in the roof of a vehicle. The lower part of the periphery of the fixing is threaded to take a fixing nut. The cable is fitted with a BNC connector 11 at its end for connection to the equipment within the vehicle.

The interior of the antenna housing is open to the interior of the vehicle via the collar 30. This enables the housing to "breath" when subject to temperature changes, which avoids stressing the seal to the mounting plate 3 and the ingress of water when a partial vacuum develops within the housing.

As described above, the antenna is designed to receive 'E' field LF signals and transmit omnidirectional, vertically polarised UHF signals. The UHF radiating section is made up of the elements 7 and 8 on the disk 6 (which is 12 cm in diameter) and the vertical mounting pillar 10 which is relatively short (3 cm). It will be appreciated from FIG. 1, which shows these elements to scale in relation to the remainder of the antenna, that the antenna is very compact. The dimensions allow the complete assembly to have a low profile, which is desirable for security applications and for tall vehicles. The simple construction also means the antenna is cheap to manufacture and easy to install because of the single hole mounting.

As the central UHF radiating element 10 is shorter than ¼ wave at the UHF transmit frequency, capacitive loading is required to achieve resonance. This loading is mainly provided by the inner disc 7 of the disk 6 mounted on top of the vertical UHF radiating element, although as the outer ring element 8 is isolated at UHF frequencies, capacitive coupling between the inner disc element 7 and outer ring element 8 means that the whole disk 6 is involved in defining the frequency of resonance of the assembly.

FIG. 3 shows the components on the PCB 9 associated with the UHF section of the antenna and also the diplexer 12 which couples the UHF and LF sections to the coaxial termination within the coaxial connector 11. Reducing the length of the vertical radiating element 10 to the size mentioned above results in reduced coupling of the power in the antenna to the ether. This results in a decrease in resistance of the radiating element 10 to around 10 ohms (compared to 50 ohms for a full ¼ wave element). The antenna element 10 is connected to the centre top of a 12 nH inductor 13 formed as a track on the PCB 9. Inductor 13 and adjustable capacitor 14 form a parallel tuned circuit. Driving the radiating element from the tap on inductor 13 provides impedance matching to the 50 ohm output of the UHF transmitter. Capacitors 15 and 16 together with inductor 17 work as a diplexer, allowing the UHF signal to share the same feeder as the received LF signals.

In addition to assisting in the loading of the UHF section, the antenna element 8 serves as the voltage probe for E-components of the LF signal. To reduce interference and noise, the PCB 9 has on it a low noise LF amplifier 18, shown in FIG. 4 which is powered by a DC supply fed to it across the conductors of the coaxial connector 11. All bar one of the support pillars which support the periphery of the disk 6 are made of electrically insulating material. The remaining one is metal and connects the antenna element 8 to the input of the amplifier 18 via a lead. The LF voltage input to amplifier 18 is passed through the inductor 13, a double tuned circuit formed of capacitors 19 and 20 and inductors 22 and 23, to reject out of band signals, and to allow the stray reactances in the voltage probe to be tuned out. The impedance of the tuned circuit should be made as high as practically possible to ensure a reasonable match to the (very high impedance) probe. This results in maximum signal voltage appearing at the lower gate of dual insulated gate FET 24 which, with the remainder of the components shown in FIG. 4, functions as a high input impedance cascode amplifier. The output of the amplifier at J2 from the tap on inductor 25 is taken to the feeder via the diplexer circuit 12 in FIG. 3.

The remote end of the coaxial feeder from connector 11 is connected to a UHF transceiver, the mobile location unit and a DC power source for the amplifier 18.

Although the embodiment described above illustrates the application of the invention to use with the location and data transmission signals of the Datatrak system, it will be apparent that the invention may be applied to an antenna for other signals, e.g. where the HF signal is a UHF cellular radio signal.

I claim:

1. A dual purpose antenna comprising first and second planar conductive antenna elements separated by a dielectric and usable with radio signals in two widely separated regions of the radio spectrum simultaneously, the first element being a radiating/receiving element for the high frequency signals in the higher region and the second element serving both as part of a resonant circuit including the first element in its high frequency operation and as a low frequency voltage probe for receiving the E-component of signals in the low frequency region, the size of the second element being negligible compared to the wavelength of the signals in the low frequency region such that the second element is effective to sample the voltage produced at a point in space by the E-component of signals in the low frequency region, whereby integrated into the antenna there is a high frequency section including the first and second elements, the first element being electrically connected to circuitry arranged such that the high frequency section is tuned and loaded for operation in the high frequency region, and there is a low frequency section comprising the second element which is electrically connected to circuitry arranged for the second element to act as a voltage probe to receive the E-component of signals in the low frequency region at the same time as the high frequency section operates in the high frequency region widely separated from the low frequency region.

2. An antenna according to claim 1 wherein the first and second antenna elements are disposed as two electrically conductive areas of metal foil on a dielectric substrate, with the first element being surrounded by the second element.

3. An antenna according to claim 2 wherein the dielectric substrate is in the form of a disk, the first element is circular and concentric with the disc and the second element is a circular annulus concentric with the first element.

4. An antenna according to claim 1 and including a third, linear antenna element whose axis extends out of the plane of the first and second elements from the centre of the first element, whereby the antenna acts to radiate signals in the high frequency region omnidirectionally, the radiated signals being polarised in the direction of the axis of the third element.

5. An antenna according to claim 4 wherein the length of the third antenna element is less than ¼ the wavelength of signals in the high frequency region.

6. An antenna according to claim 1 and having integrated therein circuitry for coupling the high frequency and low frequency signals to external equipment via a shared pair of conductors and for amplifying and bandwidth limiting the low frequency signals from the second antenna acting as a low frequency voltage probe.

7. An antenna according to claim 6 and including a third, linear antenna element whose axis extends out of the plane of the first and second elements from the centre of the first element, whereby the antenna acts to radiate signals in the high frequency region omnidirectionally, the radiated signals being polarised in the direction of the axis of the third element and wherein the third antenna element is an electrically conductive support pillar extending between the first element and a circuit board having the circuitry on it, the circuitry including an inductor which assists in tuning the high frequency section of the antenna and which is electrically connected to the first antenna element by the third antenna element.

8. An antenna according to claim 6 and including a housing including a mounting plate for the antenna, the mounting plate serving as a ground plane for the antenna and having the antenna elements and circuitry mounted thereon, with the circuitry located between the antenna elements and the mounting plate.

9. An antenna according to claim 8 wherein the mounting plate has a threaded collar to serve as a single point fixing of the antenna to the roof of a vehicle, through which a coaxial feeder cable extends for electrically connecting the antenna to external equipment.

10. An antenna according to claim 9 wherein the interior of the antenna housing is open to the exterior via the collar to allow the housing to breath.

11. The dual purpose antenna of claim 1 wherein the size of the second element is such that the second element does not resonate in the low frequency region.

12. A dual purpose antenna usable with radio signals in first and second widely separated regions of the radio spectrum simultaneously, the first region being of higher frequency than the second region, wherein the antenna comprises high frequency and low frequency sections usable with signals in the first and second of the two regions respectively, the high and low frequency sections being integrated into an antenna structure which includes first and second planar conductive antenna elements separated by a dielectric, wherein:

the first element is a radiating/receiving element for the high frequency signals in the region, the first and second elements being dimensioned and adapted to serve as part of a resonant circuit for signals in the first region, and the first element is electrically connected to circuitry arranged such that the high frequency section is tuned and loaded for operation in the first region; and the second element also serves to receive the signals in the second region and is electrically connected to circuitry arranged for the second element to act as a voltage probe to receive signals in the second regions, and the second element is dimensioned such that it is effective to sample the voltage produced at a point in space by the E-component of signals in the second region at the same time as the high frequency section operates in the first region widely separated from the second region.

13. An antenna according to claim 12 wherein the first and second antenna elements are disposed as two electrically conductive areas of metal foil on a dielectric substrate, with the first element being surrounded by the second element.

14. An antenna according to claim 12 wherein the dielectric substrate is in the form of a disk, the first element is circular and concentric with the disc and the second element is a circular annulus concentric with the first element.

15. An antenna according to claim 12 and including a third, linear antenna element whose axis extends out of the plane of the first and second elements from the centre of the first element, whereby the antenna acts to radiate signals in the high frequency region omnidirectionally, the radiated signals being polarised in the direction of the axis of the third element.

16. An antenna according to claim 12 wherein the length of the third antenna element is less than ¼ the wavelength in the high frequency region.

17. An antenna according to claim 12 and having integrated therein circuitry for coupling the high frequency and low frequency signals to external equipment via a shared pair of conductors and for amplifying and bandwidth limiting the low frequency signals from the second antenna acting as a low frequency voltage probe.

18. An antenna according to claim 12 wherein the third antenna element is an electrically conductive support pillar extending between the first element and a circuit board having the circuitry on it, the circuitry including an inductor which assists in tuning the high frequency section of the antenna and which is electrically connected to the first antenna element by the third antenna element.

19. An antenna according to claim 12 including a mounting plate for the antenna, the mounting plate serving as a ground plane for the antenna and having the antenna elements and circuitry mounted thereon, with the circuitry located between the antenna elements and the mounting plate.

20. An antenna according to claim 12 wherein the mounting plate has a threaded collar to serve as a single point fixing of the antenna to the roof of a vehicle, through which a coaxial feeder cable extends for electrically connecting the antenna to external equipment.

21. An antenna according to claim 12 wherein the interior of the antenna housing is open to the exterior via the collar to allow the housing to breath.

22. A dual purpose antenna comprising first and second planar conductive antenna elements separated by a dielectric and usable with radio signals in two widely separated regions of the radio spectrum simultaneously, the first element being a radiating/receiving element for the high frequency signals in the higher region, the second element serving both as part of a resonant circuit including the first element in its high frequency operation and as a low frequency voltage probe for receiving the E-component of signals in the low frequency region, and the third element being a linear antenna element whose axis extends out of the plane of the first and second elements from the centre of the first element, whereby integrated into the antenna there is a high frequency section including the first and second elements, the first element being electrically connected to circuitry arranged such that the high frequency section is tuned and loaded for operation in the high frequency region, and there is a low frequency section comprising the second element which is electrically connected to circuitry arranged for the second element to act as a voltage probe to receive the E-component of signals in the low frequency region at the same time as the high frequency section operates in the high frequency region widely separated from the low frequency region, and whereby the antenna acts to radiate signals in the high frequency region omnidirectionally, the radiated signals being polarised in the direction of the axis of the third element.

23. The dual purpose antenna according to claim 22 wherein the length of the third antenna element is less than ¼ the wavelength in the high frequency region.

24. The dual purpose antenna according to claim 22 wherein the third antenna element is an electrically conductive support pillar extending between the first element and a circuit board having the circuitry on it, the circuitry including an inductor which assists in tuning the high frequency section of the antenna and which is electrically connected to the first antenna element by the third antenna element.

* * * * *

UNITED STATES PATENT AND TRADEMARK OFFICE

CERTIFICATE OF CORRECTION

PATENT NO. : 5,568,157

DATED : October 22, 1996

INVENTOR(S) : Philip M. Anderson

It is certified that error appears in the above-indentified patent and that said Letters Patent is hereby corrected as shown below:

On the Title Page under Other Publications, line 3, "(1563)" should be --(1536)--.

On the Title Page under Other Publications, line 8, "Orland" should be --Orlando--.

Signed and Sealed this

Eleventh Day of March, 1997

*Attest:*

Bruce Lehman

BRUCE LEHMAN

*Attesting Officer*

*Commissioner of Patents and Trademarks*